US005199288A

United States Patent [19]

Meriläinen et al.

[11] Patent Number: 5,199,288

[45] Date of Patent: Apr. 6, 1993

[54] ELECTROMECHANICAL DOOR LOCK

[75] Inventors: Jaakko Meriläinen; Jorma Issakainen, both of Joensuu; Markku Jurvanen, Niittylahti, all of Finland

[73] Assignee: Abloy Security Ltd. Oy, Helsinki, Finland

[21] Appl. No.: 778,299

[22] Filed: Oct. 16, 1991

[30] Foreign Application Priority Data

Oct. 24, 1990 [FI] Finland ..... 905232

[51] Int. Cl.[5] ..... E05B 47/02

[52] U.S. Cl. ..... 70/279; 70/380; 292/144

[58] Field of Search ..... 70/277, 279-283, 70/380; 292/144, 201

[56] References Cited

U.S. PATENT DOCUMENTS

| | | | |
|---|---|---|---|
| 540,025 | 5/1895 | Palmer | 292/144 |
| 1,141,463 | 6/1915 | Hurd | 70/380 |
| 3,157,042 | 11/1964 | Wolz | 70/279 |
| 3,751,088 | 8/1973 | Schlage et al. | 70/279 X |
| 4,685,709 | 8/1987 | Kambic | 70/279 X |
| 4,691,542 | 9/1987 | Young | 70/279 X |
| 4,776,619 | 10/1988 | Daugherty et al. | 70/279 X |
| 5,083,448 | 1/1992 | Kärkkäinen et al. | 70/279 X |

FOREIGN PATENT DOCUMENTS

| | | |
|---|---|---|
| 0280845 | 4/1989 | European Pat. Off. . |
| 3521392 | 12/1986 | Fed. Rep. of Germany . |
| 3606620 | 9/1987 | Fed. Rep. of Germany . |
| 3742153 | 6/1989 | Fed. Rep. of Germany . |
| 453107 | 1/1988 | Sweden . |
| 8902363-4 | 2/1991 | Sweden . |

*Primary Examiner*—Lloyd A. Gall

*Attorney, Agent, or Firm*—Dellett, Smith-Hill and Bedell

[57] ABSTRACT

An electromechanical door lock comprises a lock body, which includes a bolt movable between a protruding locking position and a withdrawn releasing position by an electromechanical force transmission mechanism, a dead-locking element for dead-locking the bolt and an operating axis provided with a manual force transmission mechanism for moving the bolt and the dead-locking element. The lock body includes a coupling mechanism having a first position, in which it provides force transmission connection from both the manual force transmission mechanism and the electromechanical force transmission mechanism to the bolt. The coupling mechanism is movable by means of the key operable force transmission mechanism into a second position, in which the force transmission connection from the electromechanical force transmission mechanism to the bolt is disconnected so that the bolt is movable only through the manual force transmission mechanism.

25 Claims, 6 Drawing Sheets

ELECTROMECHANICAL DOOR LOCK

BACKGROUND OF THE INVENTION

The invention relates to an electromechanical door lock.

Electromechanical door locks of various kinds are known. General objects for electromechanical door locks are i.a. simplicity of the construction, applicability for remote-controlled operation, dead-locking possibility for the dead bolt, movement of the dead bolt also manually for instance through key operation especially for possible interruptions of current as well as for defective operation of the lock. Especially the importance of the last mentioned properties has increased according to the norms provided for the locking field.

SUMMARY OF THE INVENTION

The aim of the invention is to create a new, improved electromechanical door lock, in which the objects described above and especially the simplicity of the construction and secure operation of the lock in different operational situations are taken into account. A further aim is to provide an arrangement, which makes it possible to lock the dead bolt, when necessary, in whichever position thereof within the range of its movements, but so that the locking of the dead bolt can always be manually released for enabling its movement. Then the manual operation can refer for instance to a key operable lock mechanism, but also a turn knob or other manual means will do depending on the level of security selected for access through the door in question, in general, and for emergency situations especially.

The essential basic idea of the invention is to provide the lock body with coupling means having a first position, in which they are arranged to provide force transmission connection from both key operable force transmission means and electromechanical force transmission means to the dead bolt. In addition the coupling means are movable by means of said key operable force transmission means into a second position, in which the force transmission connection from said electromechanical force transmission means to the dead bolt is disconnected so that the dead bolt is movable only through said key operable force transmission means.

The dead-locking means can with advantage be arranged to lock the dead bolt also in its withdrawn position in the lock body. A constructionally favorable solution is accomplished when the dead-locking means comprise a turnable dead-locking element supported to the lock body and spring-loaded towards its locking position.

The key operable force transmission means include a turnable force transmission piece, which through its turning movement is arranged to move the coupling means on one hand in the direction of the dead bolt and on the other hand substantially in the longitudinal direction of the lock body so that the movement takes place transversely with regard to the dead bolt. In order to accomplish the movements of the dead bolt the coupling means are positioned in a guide groove in the dead bolt transverse to the direction of movement of the dead bolt.

In practice the turnable force transmission piece can with advantage be formed eccentric for accomplishing said movement of the coupling means substantially in the longitudinal direction of the lock body. In addition the force transmission piece comprises a pin or the like, which is arranged to cooperate with a force transmission slot arranged in the coupling means for accomplishing the movements of the coupling means in the direction of the dead bolt and thus for accomplishing the back and forth movements of the dead bolt.

Said pin or the like in the force transmission piece is flexibly supported to the turnable force transmission piece so that it is movable into said force transmission slot in all the positions of the coupling means and the dead bolt. Hereby manual movement of the dead bolt can be secured for different situations of defective operation and regardless of the position within the range of movement, in which the dead bolt has remained unmovable.

When necessary, naturally, it must be possible to remove also the dead-locking means in a simple way into the position for releasing the dead bolt so as to make it possible to move the dead bolt. This can with advantage be accomplished so that the coupling means are arranged to release the dead bolt from the locking of the dead-locking means through their said movement substantially in the longitudinal direction of the lock body.

The coupling means can with advantage be implemented so that they comprise a coupling body element, which is arranged to act on the dead-locking means, and a separate fork element arranged to cooperate with it and with the electromechanical force transmission means so as to accomplish their force transmission connection with the dead bolt. Then said movement of the coupling means substantially in the longitudinal direction of the lock body can be arranged to move said fork element substantially in the direction of the width of the lock body so that the force transmission connection from the electromechanical force transmission means to the dead bolt is disconnected.

In practice said movement of the fork element substantially in the direction of the width of the lock body can be accomplished by providing the fork element and the coupling body element with wedge-like counter surfaces. In order to secure the electromechanical operation the fork element is spring-loaded towards its position, in which the electromechanical force transmission means are connected to the dead bolt and from which it can be moved only by turning said key operable force transmission piece.

In accordance with a favorable embodiment of the invention said electromechanical force transmission means include a force transmission wheel turnable by means of an electric motor and provided with a pin or the like, which is arranged to cooperate with said fork element, and preferably with pin means for releasing the dead bolt from said dead-locking means.

For providing automatic lock control the lock body includes means, for instance a limit switch, for sensing the locking position of the dead-locking means and the position thereof releasing the dead bolt and in addition a Hall sensor for sensing the position of the dead bolt. In practice it is sufficient that the Hall sensor gives a signal when the dead bolt is in its extreme protruding position. In addition the lock body is provided with a logic unit which receives the sensor information relating to the position of the dead bolt and of the dead-locking means and gives control commands for said electromechanical force transmission means in accordance with preprogrammed principles in a way known as such.

BRIEF DESCRIPTION OF THE DRAWINGS

The invention will be further described, by way of example, with reference to the following annotated drawings, in which.

DETAILED DESCRIPTION

Figure 1:
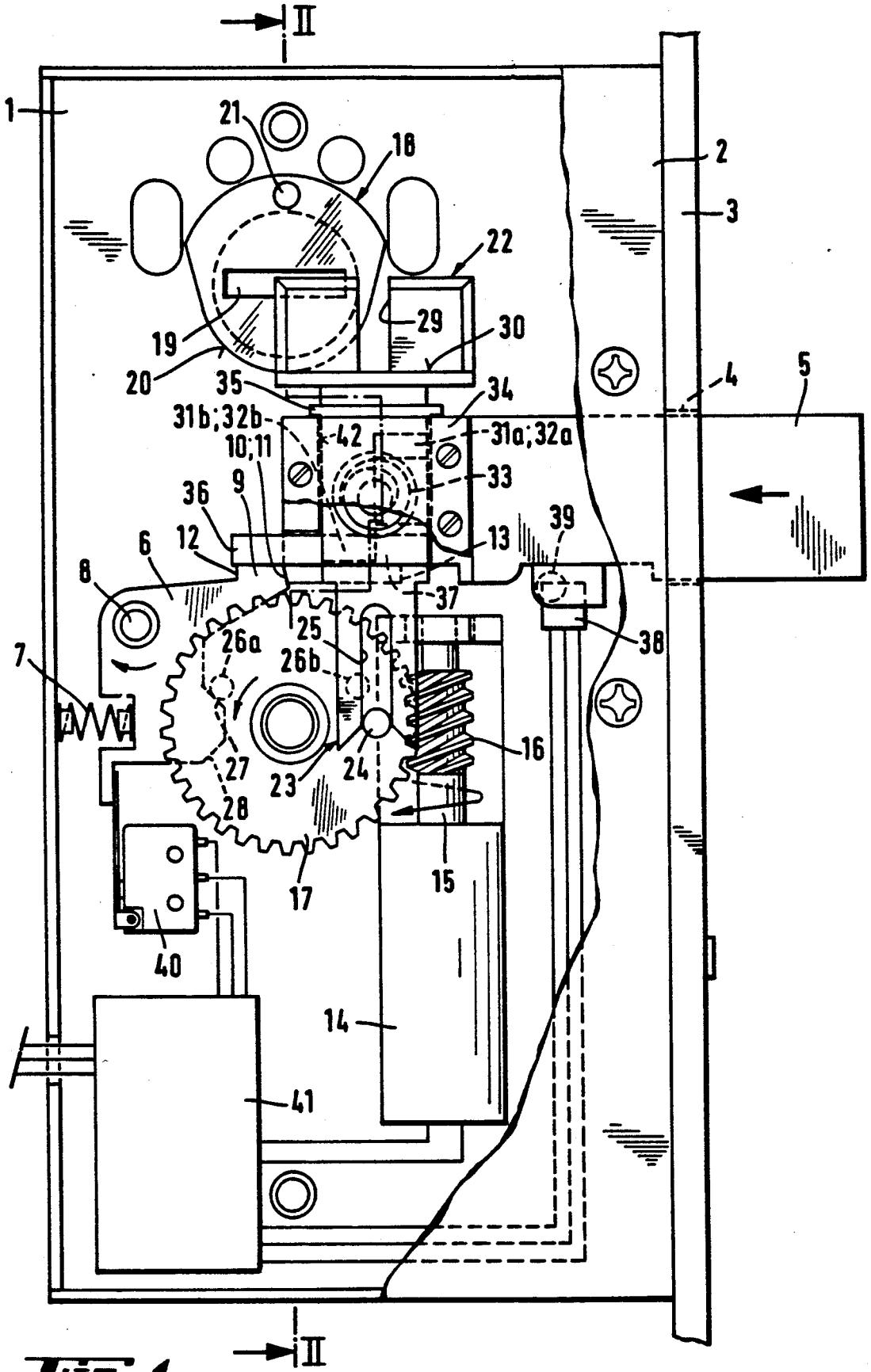
FIG. 1 shows an embodiment of the door lock according to the invention as a side view, the cover partly opened and the dead bolt in the protruding position.

In the drawing the reference numeral 1 indicates a lock body, which is provided with a cover 2, a front plate 3 and an opening 4 for a dead bolt. The lock body 1 includes a dead bolt 5, which is movable between a protruding and a withdrawn position on one hand by electromechanical force transmission means and on the other hand by key operable force transmission means. In addition the lock body includes a dead-locking element 6, which is turnably supported to the lock body by means of a pin 8 and which is urged by a spring 7 into the locking position of the dead bolt 5, i.e. in the counterclockwise direction in the figures. The dead-locking element 6 includes a protrusion 9 with a stop face 10, which is arranged to cooperate with a stop face 11 in the dead bolt 5 for dead-locking the dead bolt in its protruding position. In addition the protrusion 9 includes a stop face 12, which is correspondingly arranged to cooperate with a stop face 13 in the dead bolt 5 for locking the dead bolt in its withdrawn position (cf. FIGS. 1 and 3).

Figure 2:
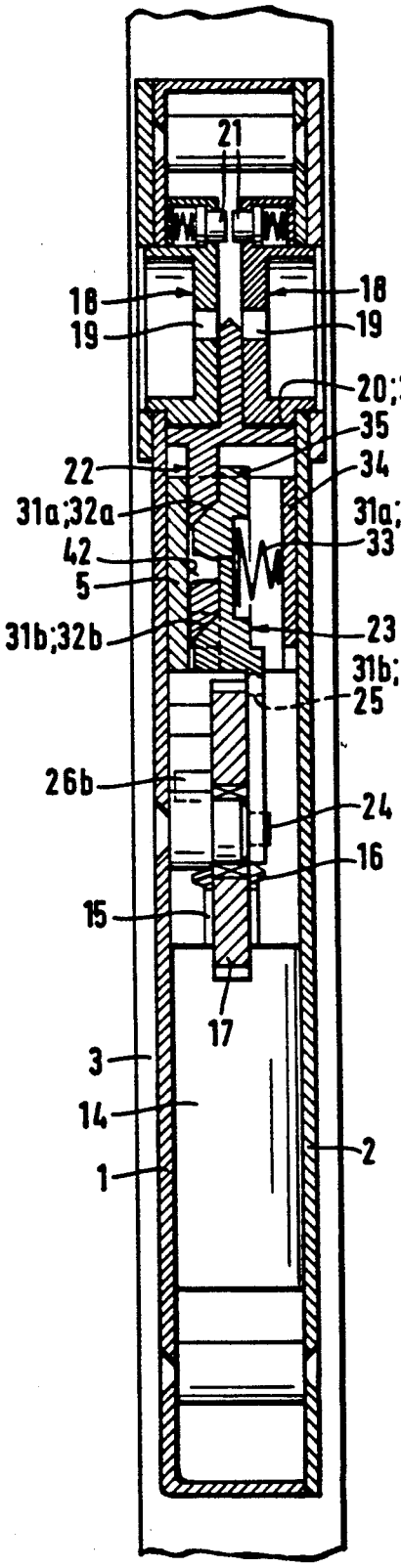
FIG. 2 shows section II—II of FIG. 1.

The electromechanical force transmission means include an electric motor 14, which is arranged to turn a gear wheel 17 through a gear member 16 positioned on a shaft 15 attached to the electric motor. The key operable force transmission means for their part include two independently from one another turnable force transmission pieces 18 having a torsion opening 19, into which for instance a key operable force transmission element of a cylinder lock is connectable in a known way (not shown in the figures). As there are two pieces 18, key operation can be accomplished from either side of the lock body when necessary. The edge of the force transmission piece 18 is formed as an eccentric guide surface 20 and in addition the piece includes a pin 21, which is spring-loaded outwards from the force transmission piece 18, i.e. in FIG. 2 towards the center part of the lock body.

The lock body includes also coupling means, by means of which the force transmission connection from both the electromechanical force transmission means and the key operable force transmission means to the dead bolt 5 is accomplished. The coupling means include a coupling body element 22 and a fork element 23 arranged to cooperate therewith. These elements are positioned in a guide groove 42 in the dead bolt so that the movements of the dead bolt 5 can be accomplished by moving the coupling means in the longitudinal direction of the dead bolt.

In FIG. 1 the dead bolt 5 is in its protruding position. The directions of movement of the parts, when the dead bolt is moved into the lock body by means of the electromechanical force transmission means, are indicated in the figure by arrows. In this case the electric motor 14 rotates the gear wheel 17 through the parts 15 and 16, whereby a pin 24 in the gear wheel 17 moves into a force transmission slot 25 in the fork element 23 attempting to move the dead bolt 5 into the lock body 1. For making this movement possible, at the same time, a pin 26*a* in the gear wheel 17 presses the dead-locking element 6 through a stop face 27 in the dead-locking element 6 into a position releasing the dead bolt (cf. FIG. 1).

Figure 3:
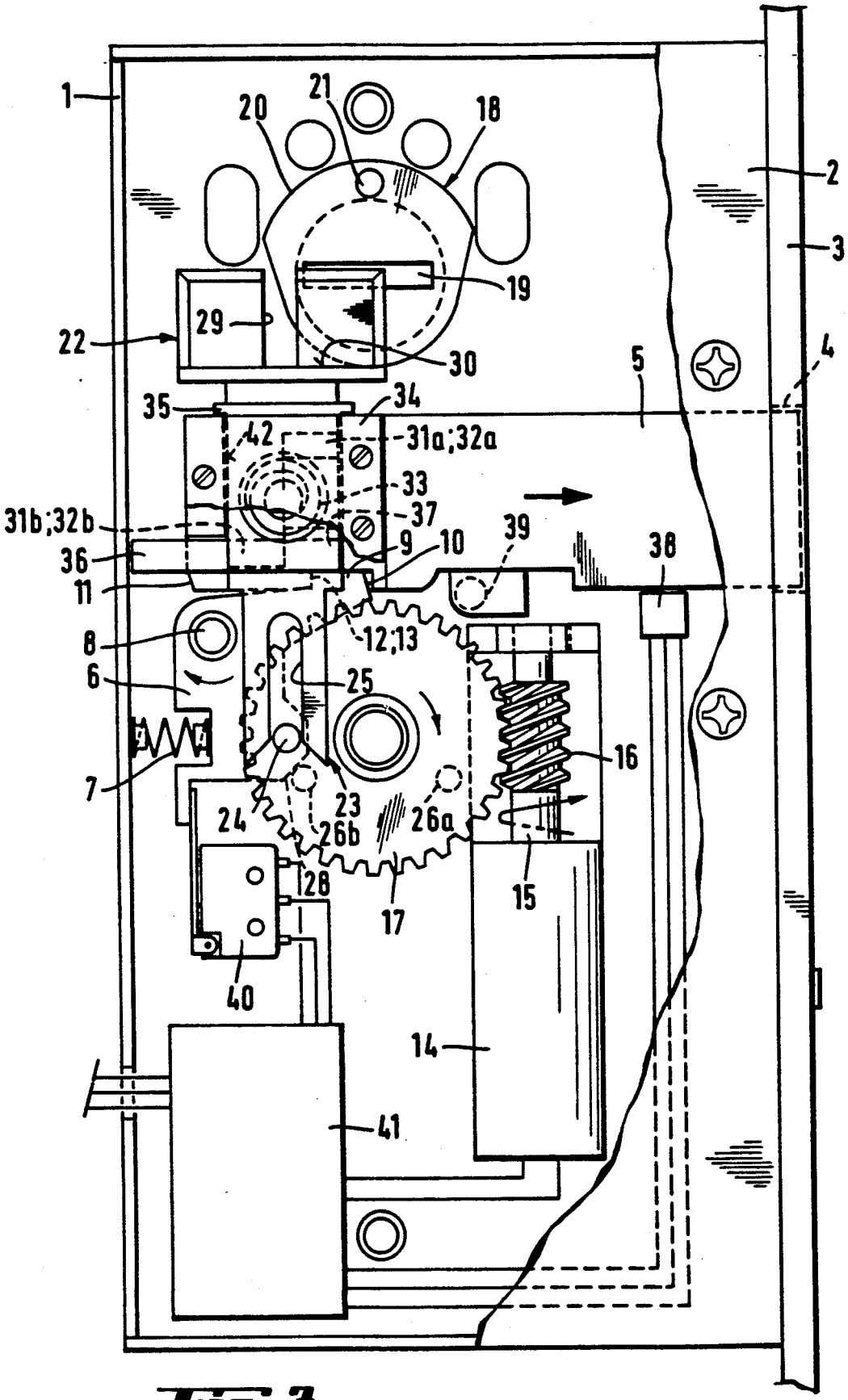
FIG. 3 shows the lock of FIG. 1 with the dead bolt withdrawn.

In FIG. 3 the dead bolt 5 is in its withdrawn position, from which it is movable into its protruding position by operating the electric motor 14 in the opposite direction as compared with the situation in FIG. 1. In this case, however, in order to release the dead bolt 5 from the locking accomplished by the stop face 12 in the dead-locking element 6, the gear wheel 17 is provided with a pin 26*b*, which hits against a stop face 28 in the dead-locking element 6 thereby turning it into a position releasing the dead bolt 5 to be moved out from the lock body 1.

Figure 5:
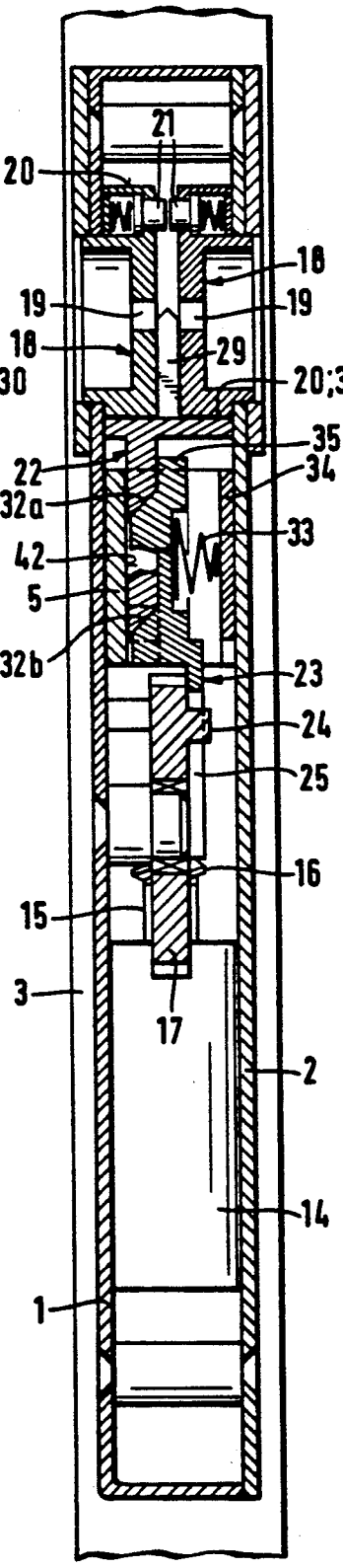
FIG. 5 shows section V—V of FIG. 4.
Figure 4:
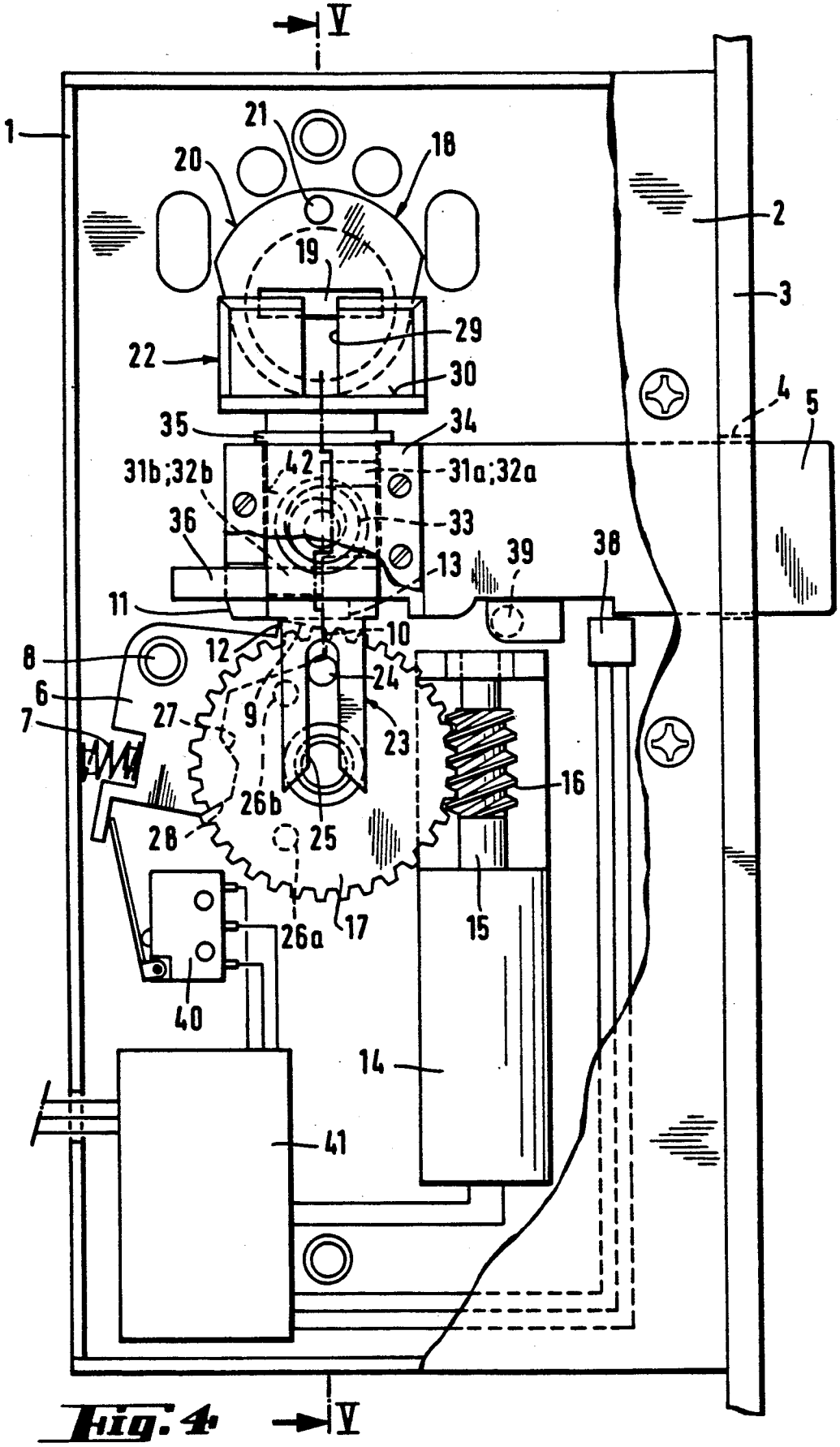
FIG. 4 shows the lock of FIG. 1 with the dead bolt locked in an intermediate position.
Figure 6:
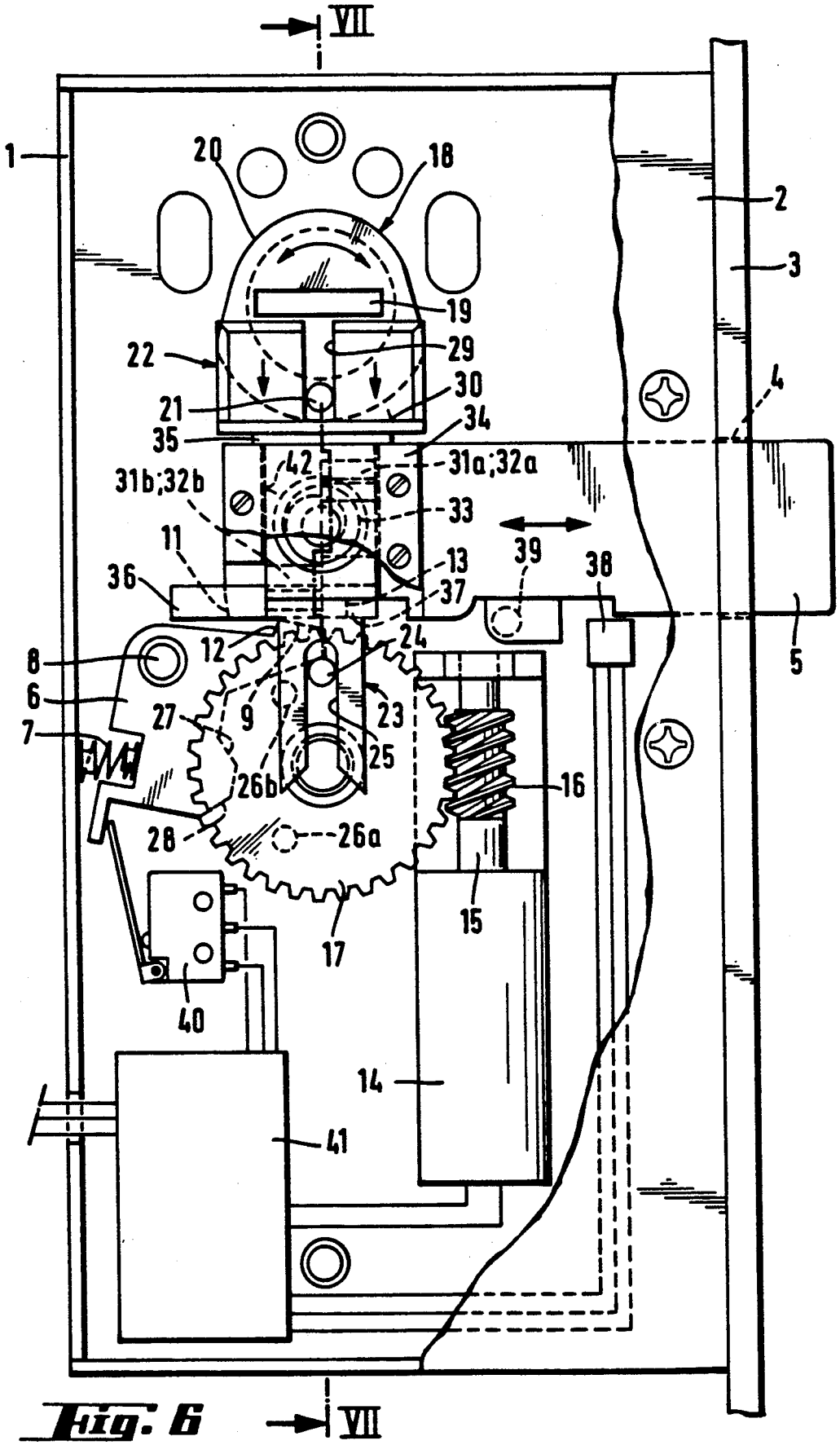
FIG. 6 shows the lock of FIG. 1 with the dead bolt moved into an intermediate position through manual operation.

FIGS. 4 and 5 disclose a situation, in which the dead bolt 5 remains in an intermediate position protruding out from the lock body less than in the extreme protruding position as shown in FIG. 1. In practice this can happen for instance when during the movement of the dead bolt 5 it hits against an obstacle blocking the movement into the extreme position. In case the obstacle does not remove, the dead bolt can first be attempted to be moved in the opposite direction by means of the electric motor 14. If this does not work either, the dead bolt 5 remains locked in this position due to frictional forces within the electromechanical force transmission means, and thereby defective operation of the lock is prevented. From this position the dead bolt can now be moved by key operation, which is described in the following with reference to the FIGS. 6 and 7.

When the force transmission piece 18 is turned from either side of the lock body 1 through a key and the dead bolt 5 is in its extreme position either protruding or withdrawn, the pin 21 moves into a force transmission slot 29 in the coupling body element 22. When the turning movement of the force transmission piece 18 is continued this results in movement of the dead bolt 5 through the coupling means and the guide groove 42 in the dead bolt 5. Before the dead bolt 5 can be moved, however, it must be disconnected from the electromechanical force transmission means through the coupling means, and in addition, the dead bolt 5 must be released from the locking of the dead-locking element 6.

Figure 7:
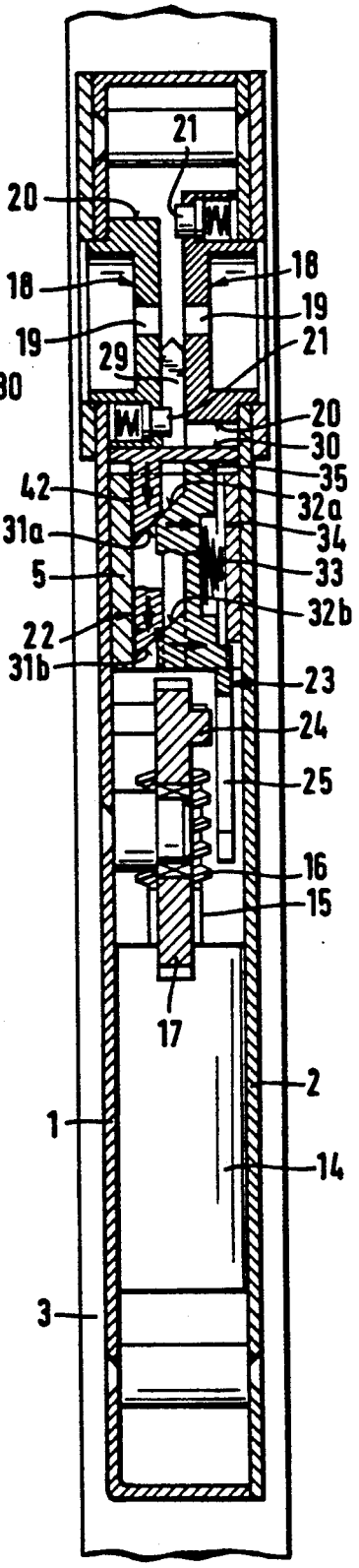
FIG. 7 shows section VII—VII of FIG. 6, FIGS. 8A and 8B show a coupling body element of the coupling means in the embodiment according to FIGS. 1-7, as a front view and a side view.
Figure 8A:
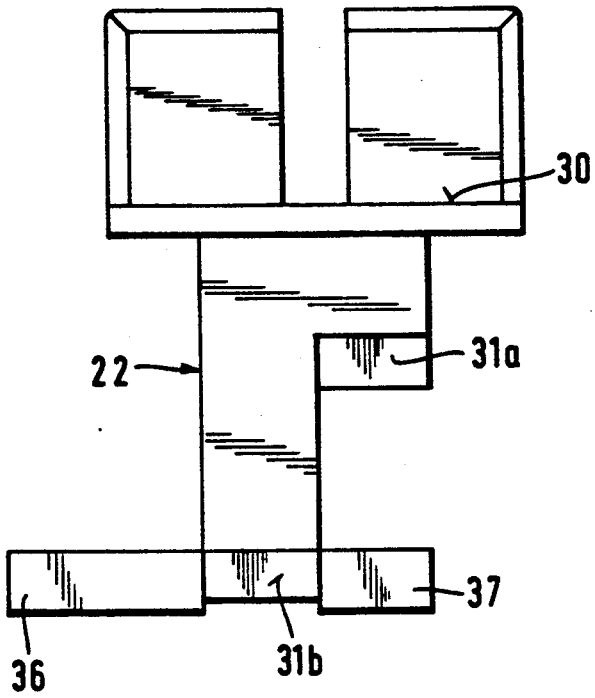
Figure 8B:
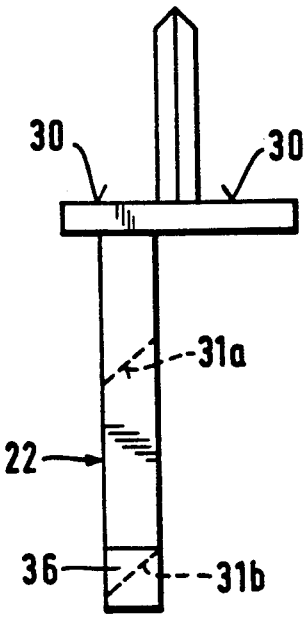
Figure 9A:
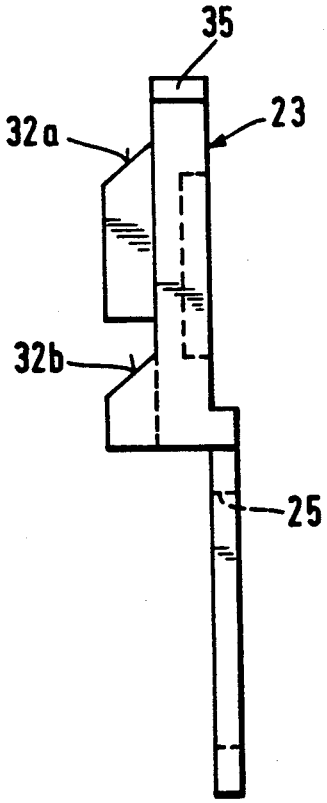
FIGS. 9A and 9B show a fork element of the coupling means in the embodiment according to FIGS. 1-7, as a side view and a front view.
Figure 9B:
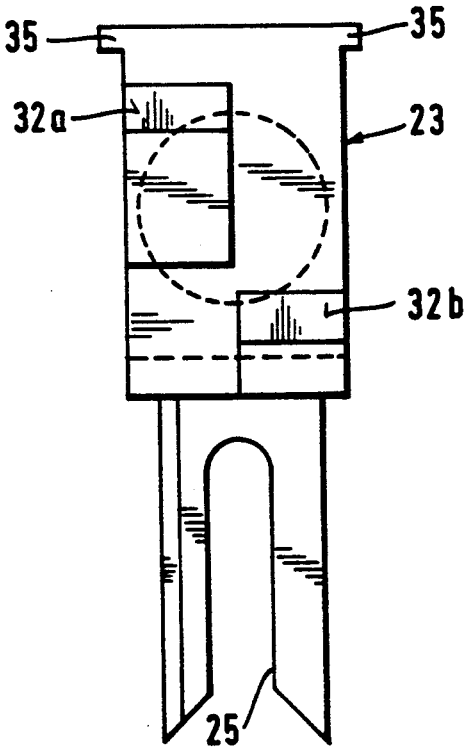

As described above the edge of the force transmission piece 18 is formed by the eccentric guide surface 20 and arranged in engagement with a force transmission surface 30 arranged in the coupling body element 22. Hence turning of the force transmission piece 18 simultaneously accomplishes movement of the coupling body element 22 transversely with regard to the dead bolt 5 downwards in the figures. Then the wedge-like force transmission surfaces 31*a* and 31*b* arranged in the coupling body element 22 and the wedge-like force transmission surfaces 32*a* and 32*b* in the fork element 23 corresponding thereto (cf. more clearly FIGS. 8 and 9) move the fork element 23 against the force of a spring 33, supported to a cover element 34 fixed on the dead bolt 5, towards the cover 2 of the lock body as shown in FIG. 7, for support members 35 in the fork element 23 prevent it from moving downwards in the figures together with the coupling body element 22. As a result of this the force transmission connection of the fork element 23 to the pin 24 and thus to the force transmission wheel 17 is disconnected (cf. FIG. 7) making it possible to move the dead bolt 5 through key operation independent of the electric force transmission means.

Releasing of the dead bolt 5 from the locking of the dead-locking means 6 occurs at the same time as the coupling body element 22 moves, under the influence of the force transmission piece 18, downwards in the figures. For this purpose the coupling body element 22 is provided with protrusions 36 and 37, which press the dead-locking element 6 through its protrusion 9 into the releasing position of the dead bolt shown in FIG. 6. The protrusion 36 is used when the dead bolt is in its protruding position and the protrusion 37 when the dead bolt is in its withdrawn position respectively.

In case the dead bolt 5 is locked into some intermediate position for some reason or other, it can h=moved through key operation, notwithstanding, as described above. For this purpose the pins 21 are flexibly supported to the force transmission piece 18 so that when the pin 21 hits the coupling body element 22 it is pressed inside the force transmission piece 18. Thus, the pin 21 can always be moved into the force transmission slot 29 of the coupling body element 22 for accomplishing the movements of the dead bolt 5.

For remote-controlled lock operation the lock body can with advantage be provided with a Hall sensor 38, which with the assistance of magnetic means 39 located in the dead bolt senses the protruding extreme position of the dead bolt, and with a limit switch 40, which correspondingly senses whether the dead-locking means 6 is in the locking or in the releasing position of the dead bolt 5. This sensor information can be fed into a logic unit 41, which can be preprogrammed so as to control the electric force transmission means for certain situations. For instance when the dead bolt meets an obstacle preventing movement of the dead bolt, whereby the dead bolt 5 may remain in an intermediate position as shown in FIGS. 4 and 5, the logic unit 41 can be arranged to control the electric force transmission means to move the dead bolt into the opposite direction. In case this does not help either and the dead bolt 5 is stuck, it can be moved through key operation as described above. The logic unit 41 can also be arranged to move said sensor information about the positions of different members in each case further into a remote control center, from which it is possible to give control commands for the electric force transmission means and to conclude, if necessary, whether the situation presumes manual operation of the lock.

The different parts can also be formed in another way than in the embodiment shown in the figures. For instance the force transmission slot 25 of the fork element 23 need not be a through-going slot but for instance only a guiding groove. Thus the invention is by no means limited to the embodiment shown but several modifications are feasible within the scope of the attached claims.

We claim:

1. An electromechanical door lock comprising:

a lock body, a bolt movable relative to the lock body in directions along a bolt axis between a locking position in which the bolt protrudes from the lock body and a releasing position in which the bolt is withdrawn substantially into the lock body relative to the locking position, dead-locking means for releasably dead-locking the bolt in its locking position, electromechanical force transmission means, manual force transmission means, and coupling means having a first condition in which they provide force transmission connection from both said manual force transmission means and said electromechanical force transmission means to the bolt and the dead-locking means for allowing operation of either force transmission means to effect movement of the bolt from its releasing position to its locking position, and a second condition in which the force transmission connection from said electromechanical force transmission means to the bolt is disconnected so that the bolt is movable from its releasing position to its locking position only through said manual force transmission means, and wherein the coupling means are changed from the first condition to the second condition by said manual force transmission means.

2. A door lock according to claim 1, wherein said dead-locking means are adapted to lock the bolt also in its releasing position.

3. A door lock according to claim 1, wherein said dead-locking means comprise a dead-locking member that is pivotable relative to the lock body between a first position in which it engages the bolt for locking the bolt against movement and a second position in which it is spaced from the bolt, said dead-locking means further comprising resilient means urging the dead-locking member towards its first position.

4. A door lock according to claim 1, wherein said manual force transmission means comprise a force transmission device that is rotatable relative to the lock body and the coupling means comprise a coupling element that is engaged by said force transmission device during rotational movement thereof so as to force said coupling element to move relative to the lock body in a direction along the bolt axis, and wherein the coupling element is restrained against movement relative to the bolt along the bolt axis.

5. A door lock according to claim 4, wherein the coupling element is formed with a force transmission slot that extends transverse to the bolt axis, and the force transmission device comprises a transmission member that is adapted to enter the force transmission slot of the coupling element and move therein to bring about movement of the coupling element in a direction along the bolt axis and thereby move the bolt.

6. A door lock according to claim 5, wherein said force transmission member is flexibly supported by the force transmission device so that the force transmission member can be moved into the force transmission slot of the coupling element at all positions of the coupling element.

7. A door lock according to claim 11, wherein said manual force transmission means comprise a force transmission device that is rotatable relative to the lock body and the coupling means comprise a coupling element that is engaged by said force transmission device during rotational movement thereof so as to force said coupling element to move relative to the lock body both in a direction along the bolt axis and in a direction along a second axis, which is transverse to the bolt axis, and wherein the coupling element is restrained against movement relative to the bolt along the bolt axis.

8. A door lock according to claim 7, wherein the bolt is formed with a guide groove that extends transverse to the direction of movement to the bolt and said coupling element extends at least partly with said guide groove.

9. A door lock according to claim 7, wherein the coupling element includes a portion for engaging the dead-locking means and releasing the bolt when the coupling element is moved in said direction along the second axis.

10. A door lock according to claim 7, wherein the coupling element is formed with a force transmission surface that extends substantially parallel to the bolt axis and the force transmission device has an eccentric guide edge for engaging said force transmission surface of the coupling element and bringing about movement of the coupling element in said direction along the second axis.

11. A door lock according to claim 10, wherein the coupling element is formed with a force transmission slot that extends transverse to the bolt axis and the force transmission device comprises a transmission member that is adapted to enter the force transmission slot of the coupling element and move therein to bring about movement of the coupling element in a direction along the bolt axis and thereby move the bolt.

12. A door lock according to claim 11, wherein said force transmission member is flexibly supported by the force transmission device so that the force transmission member can be moved into the force transmission slot of the coupling element at all positions of the coupling element.

13. A door lock according to claim 1, wherein said coupling means comprise a first coupling element for connecting the manual force transmission means to the bolt and a second coupling element for connecting the electromechanical force transmission means to the bolt, the first and second coupling elements being restrained against movement relative to the bolt along the bolt axis.

14. A door lock according to claim 13, wherein movement of the first coupling element in a direction along a second axis that is perpendicular to the bolt axis brings about movement of the second coupling element in a direction along a third axis that is substantially perpendicular both to the bolt axis and to the second axis, and wherein such movement of the second coupling element causes the force transmission connection between the electromechanical force transmission means and the bolt to be disconnected.

15. A door lock according to claim 14, wherein the first coupling element is formed with a wedging surface that engages the second coupling element to bring about movement of the second coupling element in said direction along the third axis when the first coupling element moves in said direction along the second axis.

16. A door lock according to claim 15, wherein the second coupling element is formed with a wedge surface that engages the wedge surface of the first coupling element in complementary fashion.

17. A door lock according to claim 14, comprising resilient means that spring load the second coupling element towards the position in which is provides force transmission connection between the electromechanical force transmission means and the bolt.

18. A door lock according to claim 14, wherein said electromechanical force transmission means comprise an electric motor, a force transmission wheel mounted in the lock body for rotation, means drivingly coupling the electric motor to the force transmission wheel, and a force transmission member mounted on the force transmission wheel and engagable with the second coupling element to move the second coupling element along the bolt axis.

19. A door lock according to claim 18, wherein the second coupling element defines a force transmission slot extending substantially perpendicular to the bolt axis, and the force transmission member comprises a pin that moves in the force transmission slot on rotation of the wheel for displacing the second coupling element along the bolt axis.

20. A door lock according to claim 18, wherein the force transmission wheel is provided with at least one pin for engaging the dead-locking means to release the bolt.

21. A door lock according to claim 1, including means for sensing the position of the dead-locking means.

22. A door lock according to claim 1, including means for sensing the position of the bolt along the bolt axis.

23. A door lock according to claim 22, wherein the means for sensing the position of the bolt comprise a Hall-effect sensor.

24. A door lock according to claim 23, wherein the Hall-effect sensor provides a signal when the bolt is in its locking position.

25. A door lock according to claim 1, comprising sensor means for sensing the condition of the dead-locking means and the position of the bolt, and wherein the lock body contains a logic unit for receiving the sensor information provided by the sensor means and for controlling operation of the electromechanical force transmission means.

* * * * *